United States Patent [19]

Vidoni

[11] Patent Number: 4,637,308

[45] Date of Patent: Jan. 20, 1987

[54] SCREEN PRINTING APPARATUS USING PARTIALLY SATURATED SOLVENT INKING ATMOSPHERE

[76] Inventor: Werner Vidoni, Stoesselstrasse 25, 8720 Schweinfurt, Fed. Rep. of Germany

[21] Appl. No.: 806,104

[22] Filed: Dec. 6, 1985

[30] Foreign Application Priority Data

Dec. 19, 1984 [DE] Fed. Rep. of Germany ..... 3446254

[51] Int. Cl.[4] ..... B41F 15/00

[52] U.S. Cl. ..... 101/114; 101/125

[58] Field of Search ..... 101/114–115, 101/116, 119–120, 124–125, 129

[56] References Cited

U.S. PATENT DOCUMENTS 1,850,253 3/1932 Wolf et al. ..... 101/114
2,011,363 8/1935 Hommel ..... 101/115
4,254,707 3/1981 Lambert et al. ..... 101/129

FOREIGN PATENT DOCUMENTS 755556 5/1933 France ..... 101/114
51484 3/1982 Japan ..... 101/125
283241 12/1970 U.S.S.R. ..... 101/125

*Primary Examiner*—E. H. Eickholt
*Attorney, Agent, or Firm*—Welsh & Katz, Ltd.

[57] ABSTRACT

A screen printing apparatus is provided with a screen and a doctor blade movable on one side over the screen for pressing ink through the screen onto a printing stock. The screen is stretched over the open side of an otherwise closed box. The open side of the box is closable by means of a cover detachably connected thereto. The movable doctor blade is located inside the box. Also within the box and/or the cover is a device for generating a solvent atmosphere.

25 Claims, 5 Drawing Figures

SCREEN PRINTING APPARATUS USING PARTIALLY SATURATED SOLVENT INKING ATMOSPHERE

The present invention relates generally to a screen printing apparatus having a doctor blade movable over one side of a screen, so as to press ink through the screen and onto a printing stock.

In screen printing, as is well known, a fine mesh fabric of silk, metal or synthetic material is used. The mesh openings are closed in the places where printing is not desired. Printing ink is conveyed by means of a doctor blade, through the openings of the screen onto the object to be printed, which is situated under the screen. Movement of the doctor blade is effected manually or by machine.

The general practice in the industry is to bring objects to be imprinted to individual, rather large and expensive machines, where the objects are directly imprinted. This is disadvantageous, however, in that the cost is relatively high, due to the cost of transportation and storage, as well as operation by specialized personnel.

Also known are simple screen printing apparati having hand screens and manually guided doctor plates. A problem in these devices, however, is that the ink in the screen dries relatively rapidly and the clothes and hands of the operator are frequently soiled by ink. In addition, the operation of these screen printing apparati requires trained workmen.

Also, because of the rapid drying of the ink in the screen, a rapid printing sequence must be maintained with few pauses. Nevertheless, frequent cleaning of the screen with solvents is indispensable.

Underlying the present invention, therefore, is the problem of creating a screen printing unit of the type mentioned at the outset in which excessively rapid drying of the ink on the screen can be avoided and in which operation of the device is simple, and inexpensive.

Accordingly, in the present invention this problem is solved by having a screen stretched over the open side of an otherwise closed box. The open side of the box is closable by means of a cover detachably connected to the box. A movable doctor blade is located in the interior of the box. A device is also provided in the box and/or the cover for generating an at least partially saturated solvent atmosphere. As a result, the screen and any residual ink are arranged after completion of the printing operation in a space closed on all sides, and having an atmosphere saturated or at least largely saturated with solvent. Consequently, unlike prior art devices, the ink does not dry in the screen.

In order to print objects it is merely necessary to remove the cover, after which it is possible to proceed immediately with the printing process. The doctor blade and the printing ink are nevertheless safely stored inside the box, whereby the operator avoids contact with the ink. Accordingly there is no danger of soiling the operator's hands or clothing.

A further advantage of the present invention is that the operation of the apparatus is very simple and is comparable to the use of a stamp. The screen printing apparatus can be brought to the printing stock and not vice versa. This is especially advantageous in the case of large and bulky printing stock. Vertical surfaces can also be printed without problems, and the apparatus itself can be directly applied to the printing stock.

When, after completion of the printing process, the cover is again joined with the box, a solvent atmosphere is rapidly restored in the interior of the box, which prevents the clogging of the screen meshes. Experiments have shown that even after a period of several days, the screen printing apparatus is immediately ready for use again.

In order to avoid fouling of the screen and to improve contact between the screen and the solvent atmosphere, it is advantageous for the inside of the cover to be spaced from the screen. Similarly, the apparatus for generating a solvent atmosphere can be located inside of the cover, and separated from the screen.

In order to generate a solvent atmosphere a number of devices, apparati, means and the like can be used. What is essential is that such devices be able to store solvents for later use. Thus, for example, felt material, sponges or the like can be used for this purpose.

The type of mechanism used for generating a solvent atmosphere is flexible, depending on the size of the box and according to the particular requirements. In some cases it is possible to make do with only a single solvent dispensing device. In general, however, at least one further solvent dispensing device is positioned in the cover for generating the solvent atmosphere, so that the solvent is distributed uniformly in the interior of the box and the cover.

The connection between the box and the cover should be rapidly detachable and substantially airtight. For this purpose for example, an elastic seal surrounding the connection between the box and the cover may be provided.

The seal may also be used as a positioning device for the printing stock. In addition, the seal can serve as a clamp for the printing stock. In this manner the seal fulfills a multiple function.

During movement of the doctor blade within the interior of the box, the box should be ventilated as little as possible. In correspondence to the requirements of the object being printed, the doctor blade movement can be circular, an arc or linear. Corresponding drive means are therefore provided, but the closed character of the space within the box is maintained. For example, electrical or pneumatic drives can be provided in the interior of the box, which can be operated from the outside in a suitable manner. Alternatively, the doctor blade can be fastened to a shaft which extends out of the box on the side opposite the screen. The opening around the shaft is sealed off so as to prevent venting of solvent. When the shaft is rotated, circular movement of the doctor blade is effected. If the shaft extends eccentrically out of the box, it is provided on its upper end with an operating lever and on its lower end with a connecting arm extending at substantially a right angle to it. The doctor blade can be arranged on the connecting arm in such a way that it executes a windshield-wiper-type movement across the screen.

In order to improve printing quality, it is advantageous to have the shaft provided with a lifting mechanism which may be activated at the point where the motion of the doctor blade is reversed. Through the lifting mechanism, the doctor blade can be lifted over the ink which has been thrust ahead of itself during the printing process. Thereafter, in the return movement, the ink may again be thrust in front of the doctor blade. In one such embodiment, on the part of the shaft extending from the box, a drag arm is fastened having a wedge-shaped block on its free end. The drag arm is carried along by the rotation of the shaft between stops. After striking against a stop, the shaft is lifted over the wedge-shaped block. As a result, the doctor blade is lifted over the ink.

Instead of a circular or a windshield-wiper-type movement, the doctor blade can also be connected to a linear guide, having guide elements slidingly engaged on opposite sides of the box. In one embodiment, the guide elements extend laterally through sealed slits in the side of the box. The slits may, for example, be provided with two lip seals lying one over the other, between which there is guided an outwardly extending guide pin. The lip seals are sufficiently elastic to support the guide pins.

In another embodiment of the doctor blade, no seal of the guide is required. A slidable magnetic rail is presented on the outside of the box having two downwardly depending magnetic arms which are located on opposite sides of the magnetic rail. On the doctor blade or on the guide elements proximate the magnetic rail there are likewise arranged magnets or magnetizable parts. In this embodiment, when the magnetic rail is moved, the magnetic force acts to shift the doctor blade. However, the box walls should not be of magnetizable material.

During the forward and backward movement of the doctor blade, printing is performed. In one embodiment, two doctor blades are arranged in the shape of a roof and joined to one another on their upper ends. The ink is positioned between the two doctor blades; one doctor blade pushes the ink across the screen in each direction. Additionally, adjustable sensors for the printing stock may be provided on the outside of the box on two opposing sides. The two adjustable sensors provide easy placement of the printing stock against the edge of the box and a precise spacing of the print image from the edge of the printing stock. After adjustment of the sensors, subsequently following identical products may be fed in precise alignment.

In a further, very advantageous development, the box may consist at least partially of transparent material. By reason of such transparency, the printing stock can be precisely positioned by sight from above, without requiring any sensing mechanism or other marking points or stops.

It is also advantageous for the mechanism for generating a solvent atmosphere (for example a felt), to be arranged on a portion of the device turning with the doctor blade. This may be, for example, the horizontal doctor blade arm. In this manner, visibility into the box is not impeded.

In a preferred embodiment of the invention, the print image is copied onto a copying area of the screen and the means of the remaining area of the screen are sealed. If the sealing of the remaining area of the screen is carried out with a transparent adhesive or a screen filler, the printing stock remains at least partially visible. In this manner it is possible to see exactly where one is printing.

In order to accomplish the aforesaid process, the print image is copied onto an opaque copying area which corresponds to the outline of the print image. The copying area is permeable to ink so that only the area to be printed is free to absorb ink within the copying layer.

DETAILED DESCRIPTION OF THE PREFERRED EMBODIMENT

Figure 1:
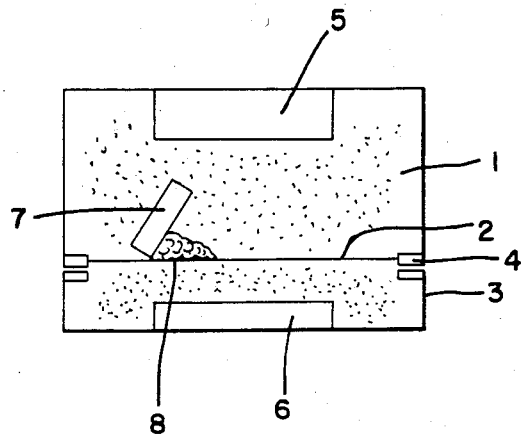
FIG. 1 is a schematic diagram of a screen printing apparatus.

The screen printing apparatus of the present invention, described in FIG. 1 only in its theoretical construction, presents a rectangular box 1 which is closed on all sides but the bottom. The bottom of box 1 is covered with a screen 2. Under the box 1 there is a cover 3 which is connected to the box 1 and tightly sealed by elastic seal 4.

Both in the box 1 and also in the cover 3 there are present mechanisms 5 and 6, respectively, for the generation of a saturated solvent atmosphere. Mechanisms 5 and 6 consist, in this embodiment of the invention, of a piece of felt material saturated with solvent. As shown in FIG. 1, the felt 6 is arranged in the cover 3 in such a way that the screen is positioned over felt 6 and is separated therefrom. In this manner, fouling of the screen mesh is avoided and solvent can evaporate unimpeded from the felt 6.

Further provided inside box 1 is a doctor blade 7, which presses ink 8 through the screen. For this purpose the connection between the box 1 and the cover 3 is released, the cover is removed and the object to be imprinted is then laid under the screen 2.

The form of the box is determined by the object to be printed. In general, the screen printing apparatus of the present invention will be used as a hand tool in smaller sizes. If the doctor blade 7 is moved circularly over the screen, the box 1 will be constructed as a tube. In the case of windshield-wiper-type or a linear movement, the box may be constructed in rectangular or square form. Obviously, however, other forms are possible within the scope of the invention.

Figure 2:
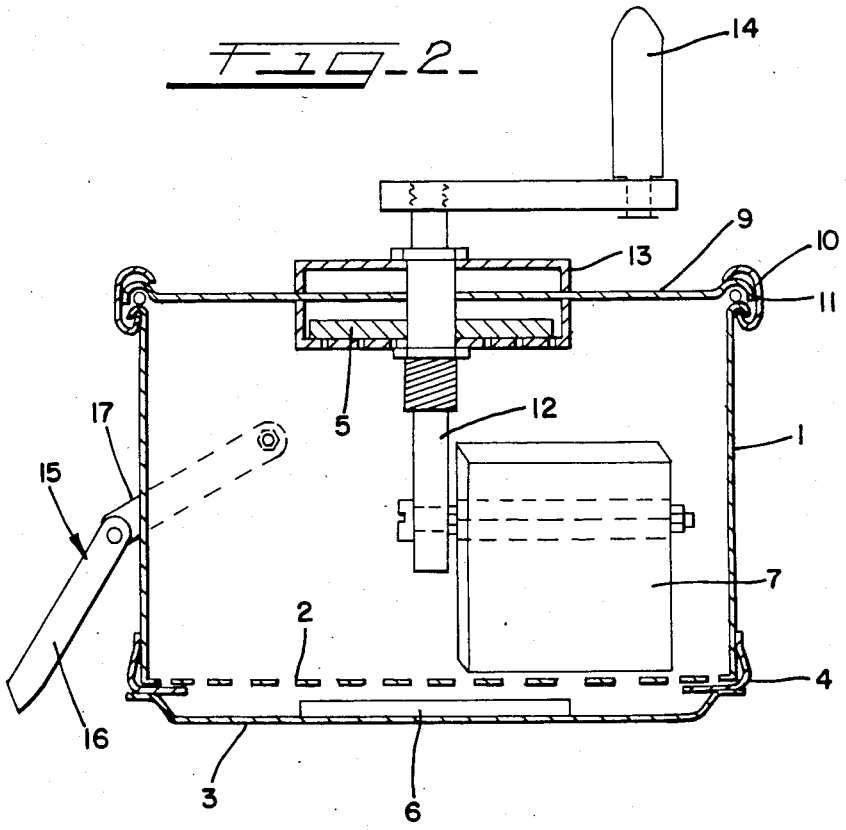
FIG. 2 is a vertical section of the screen printing apparatus of FIG. 1, having a doctor blade adapted for circular movement.

In FIG. 2 there is presented in cross section a screen printing apparatus with a box 1 in tubular form. As can be seen, the box has an upper cover 9, which is connected via a snap lock 10 (not represented in detail). Interposed between cover 9 and box 1 is sealing ring 11 along the cylindrical circumferential wall of the box 1.

In the upper cover 9 there is a central bore, through which extends a shaft 12. In order to support shaft 12, the upper cover 9 is provided with a support member 13. Felt 5 is positioned within support member 13 for generating a saturated solvent atmosphere. A plurality of openings are provided through the bottom of support member 13 so as to allow passage of the vapors from the solvent in felt 5 into box 1.

On the upper end of the shaft 12 there is provided an operating lever 14 for manual rotation thereof. On the lower end of shaft 12 is doctor blade 7, connected to shaft 12 by means of a screw or other conventional fastening means.

In order to seal the interface between the box 1 and the cover 3 there is provided a sealing part 4 which is preferably a rubber strip. As is evident from FIG. 2, the rubber strip 4, after the removal of the cover 3, simultaneously acts as a spacer and a hold-down device for the printing stock. When doctor blade 7 is not being moved, screen 2 lies at a slight distance above the printing stock. Only when doctor blade 7 is moved does the doctor blade press by reason of the elasticity of the screen 2 onto the printing stock. If the printing stock is a flat object the dimensions of which are greater than the diameter or the cross section of the rubber strip 4, then the printing stock is clamped between the object and the rubber strip 4 during printing.

In a preferred embodiment of the invention, there are arranged sensors 15 oppositely disposed on box 1, and having two sensing arms 16 and 17. Sensing arm 17 is articulately fastened to the wall of the box 1 and sensing arm 16 is articulately fastened to the other end of the sensing arm 17 and has a point on its free end. After an alignment of the two sensors 15, it is possible to precisely align the printing stock to the screen printing apparatus during printing. In this manner, identical print images are always produced with a constant spacing from the edge of the printing stock.

After completion of the printing operation, the cover 3 is again joined with the box 1. This connection is preferably a snap (rapid) connection. However, it is also sufficient in some cases if box 1 is merely placed on the cover 3, in which case a sufficient seal is achieved by reason of the weight of box 1.

One method of refilling of ink is to remove cover 9 and apply ink directly to screen 2. Obviously, however, the ink can be introduced in other ways into the interior of the box 1. Likewise, the support member 13 on the upper side of box 1 can be provided with one or more openings through which solvent for the felt 5 can be added. The composition of the solvent depends on the type of ink used, but is generally well known by those skilled in the art, and will not be discussed in more detail here.

Figure 3:
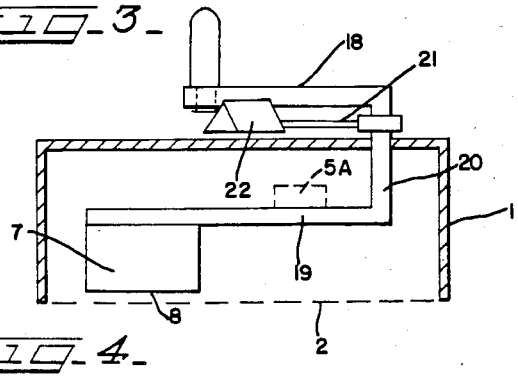
FIG. 3 is a vertical section of the screen printing apparatus of FIG. 1, having a doctor blade adapted for windshield-wiper-type movement.
Figure 4:
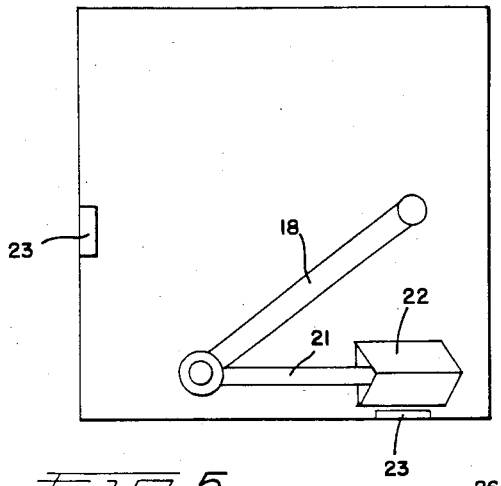
FIG. 4 is a schematic diagram of the screen printing apparatus of FIG. 3.

In FIGS. 3 and 4 there is presented another embodiment of the screen printing apparatus of the present invention with a doctor blade 7 movable in the manner of a windshield wiper. The cover 3 is omitted from these figures but remains part of the apparatus.

As is seen in FIG. 3, the shaft 20 extends vertically from the box 1 and then horizontally above box 1. An operating lever 18 is attached to the projecting portion of shaft 20. On the lower part of the shaft 20, lying in the box 1, is a connecting arm 19 which extends at a right angle from the shaft 20. On the front end of the connecting arm 19 is the doctor blade 7. In operation of the operating lever 18, the doctor blade 7 executes a windshield-wiper-type movement over the screen 2, which pushes the ink 8 ahead of it. At the end of the windshield-wiper-type movement, the doctor blade 7 is lifted over the ink 8 at the point where the doctor blade 7 is reversed. Consequently, during the return movement, the doctor blade can likewise press ink through the screen 2. However, a lifting mechanism for doctor blade 7 is required. One lifting mechanism, shown in FIG. 3, is a drag arm 21, the front end of which is fastened to a wedge-type block 22. The wedge shape of the block 22 extends upwardly and has a height such that in swinging operating lever 18, the block 22 and the drag arm 21 are pushed in front of the horizontal part of the operating lever 18. When block 22 runs against one of its two end stops 23, which are fastened to the upper side of the box 1, the shaft 20 is lifted by the further movement of the operating lever 18 over the block 22. In this manner the doctor blade 7 is also lifted over the ink on the screen. During the return movement of the operating lever 18, the block 22 is again pushed in front of operating lever 18, whereby the doctor blade 7 again pushes the ink in front of it as it is rotated.

Figure 5:
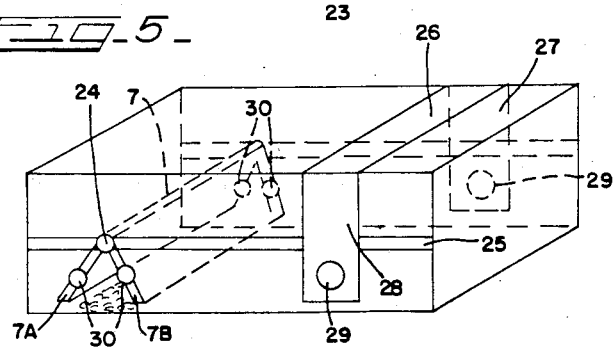
FIG. 5 is a perspective view of the screen printing apparatus of FIG. 1 having a magnetically movable doctor blade.

In FIG. 5 there is presented a screen printing apparatus having linear shifting of the doctor blade 7. The doctor blade 7 has in this case two wiper blades 7A and 7B, which form a roof shape. At the apex of the roof shaped configuration the two wiper blades 7A and 7B are joined to one another and have a guide part 24 extending therefrom on each side. The guide part 24 can be a bearing pin or the like, which runs in a recess or groove 25 in the vertical walls of the box 1. Preferably two recesses 25 and two guide parts 24 are provided on the two opposite sides of the box 1.

As further shown in FIG. 5 on the outside of box 1 there is provided a magnet rail 26 having two magnet arms 27 and 28 extending therefrom. On the inside of magnet arms 27 and 28 are magnets 29. Proximate magnets 29 on the wiper blades 7A and 7B are magnets 30 to support doctor blade 7. If the magnet rail 26 is slid over the box 1, then by reason of the magnetic force between magnets 27, 28 and 29, the doctor blade 7 with its two wiper blades 7A and 7B follows correspondingly after. The ink 8 is present between the two doctor blades; as a result, wiper blades 7A and 7B may be used to spread ink 8 on screen 2 in each direction of movement.

Instead of magnets 30, it is also sufficient if the wiper blades 7A and 7B consist of magnetizable material. In such case, the wiper blades 7 will follow the magnetic rail 26. Magnets 30 can also be positioned on other locations on the doctor blade 7. It is only essential that the arrangement and allocation and magnets and/or magnetizable parts is made so that a magnetic force acting from outside through the box wall is provided which is sufficient to move wiper blades 7A and 7B.

Box 1 may also consist of transparent material. In such case, the mechanism for generating a solvent atmosphere is positioned on a part of the device which turns with the doctor blade 7; as shown in broken lines in FIG. 3, felt 5A is arranged on the connecting arm 19.

The foregoing description and drawings merely explain and illustrate the invention and the invention is not limited thereto except insofar as those who have the disclosure before them are able to make modifications and variations therein without departing from the scope of the invention.

What is claimed is:

1. A screen printing apparatus comprising:
- a substantially closed box, open on one side;
- a screen attached to and disposed across said open side of said substantially closed box;
- a cover detachably joined to said box and adapted for closing said open side of said box;
- a movable doctor blade located in the interior of said box; and
- means for generating a partially saturated solvent atmosphere within said box.

2. The screen printing apparatus of claim 1 wherein said cover has an inside surface, said inside surface of said cover being spaced from said screen so as to avoid deposition of ink on said inside surface of said cover.

3. The screen printing apparatus of claim 2 wherein said means for generating a solvent atmosphere comprises:
- a first solvent dispensing member disposed on said inside surface of said cover and spaced from said screen so as to prevent deposition of ink on said means for generating a solvent atmosphere and deposition of solvent directly on said screen.

4. The screen printing apparatus of claim 3 wherein said means for generating a solvent atmosphere comprises:

a second solvent dispensing member disposed within said interior of said box.

5. The screen printing apparatus of claim 1 wherein said means for generating a solvent atmosphere comprises:

a body adapted for storing solvent and slowly releasing it.

6. The screen printing apparatus of claim 5 wherein said body is selected from the group consisting of a solvent-absorbing felt, solvent-absorbing sponge or the equivalent thereof.

7. The screen printing apparatus of claim 1 wherein an elastic sealing part is interposed between said box and said cover.

8. The screen printing apparatus of claim 7 wherein said sealing part separates said screen from said printing stock when said doctor blade is stationary, but allows contact between said screen and said printing stock during movement of said doctor blade.

9. The screen printing apparatus of claim 7 wherein said sealing part is adapted for fixedly positioning said printing stock during printing.

10. The screen printing apparatus to claim 1 and further comprising:

drive means for moving said doctor blade within said box.

11. The screen printing apparatus of claim 1 and further comprising:

a shaft fixedly attached to said doctor blade and extending outwardly from said box and away from said screen.

12. The screen printing apparatus of claim 11 wherein said shaft is axially disposed within said box and said doctor blade is constructed and arranged for circular movement across said screen corresponding to rotation of said shaft.

13. The screen printing apparatus of claim 11 wherein said shaft extends through one side of said box opposite said screen, said side of said box opposite said screen being constructed as a removable cover.

14. The screen printing apparatus of claim 1 and further comprising:

an upper end and a lower end of said shaft, said shaft extending eccentrically from said box;

an operating lever at said upper end of said shaft; and a connecting arm at said lower end of said shaft, said connecting arm extending at a substantially right angle to said shaft and having said doctor blade mounted thereon whereby said doctor blade may be pivotally and reversibly moved across said screen.

15. The screen printing apparatus of claim 14 and further comprising:

stops means for limiting said pivotal movement of said doctor blade to a fixed arc; and lifting means for lifting said doctor blade over said ink on said screen when said pivotal movement of said doctor blade is reversed at the end of said movement.

16. The screen printing apparatus of claim 15 wherein said lifting means comprises:

a drag arm member fastened to said portion of said shaft extending out of said box, said drag arm member having a wedge-shaped block fixedly attached to a first end thereof, said drag arm member being carried by said shaft during rotation thereof whereby pivotal movement of said shaft is effective to cause said wedge-shaped block to impact said stop means, said wedge-shaped block being thereby lifted over said stop means so as to lift said shaft, whereby said doctor blade is lifted off of said screen and behind said ink.

17. The screen printing apparatus of claim 1 and further comprising:

linear guide means for guiding said movement of said doctor blade; said guide means including a plurality of guide part members oppositely disposed on opposite sides of said box.

18. The screen printing apparatus of claim 17 wherein said linear guide means further comprises:

a slidable magnetic rail having two magnetic arms downwardly depending therefrom, said magnetic arms each having magnets located on opposing sides of said box; and one of more magnets positioned on said doctor blade proximate said magnets on said magnetic rail, thereby effecting movement of said doctor blade when said magnetic rail is moved.

19. The screen printing apparatus of claims 1 wherein said doctor blade comprises:

two wiper blade arms disposed in an inverted V configuration and connected to each other at their respective upper ends.

20. The screen printing apparatus of claim 1 and further comprising:

adjustable sensor means for positioning said printing stock relative to said screen.

21. The screen printing apparatus of claim 20 wherein said sensor means comprises:

first and second sensing arms movably joined to one another, said first sensing arm being arranged with a first end movably attached to a wall of said box and said second sensing arm being provided with a sensing point adapted for contact with and guidance of said printing stock.

22. The screen printing apparatus of claim 1 wherein said box includes at least a portion thereof constructed of a substantially transparent material.

23. The screen printing apparatus of claim 22 wherein said mechanism for generating a solvent atmosphere is fixedly positioned relative to said doctor blade so as to move the conjunction with said doctor blade.

24. The screen printing apparatus of claim 1 wherein said screen comprises:

a copying area adapted for copying of the image to be printed and a remaining area of said screen having a closed mesh so as to prevent the passage of ink therethrough.

25. The screen printing apparatus of claim 24 wherein said remaining area of said screen is closed with substantially transparent screen filler.

* * * * *